US005394673A

United States Patent [19]

Hartness

[11] Patent Number: 5,394,673

[45] Date of Patent: Mar. 7, 1995

[54] GRID FINGERS

[75] Inventor: Robert G. Hartness, Greer, S.C.

[73] Assignee: Hartness International, Inc., Greenville, S.C.

[21] Appl. No.: 139,398

[22] Filed: Oct. 19, 1993

[51] Int. Cl.[6] ..... B65B 39/02

[52] U.S. Cl. ..... 53/248; 53/262

[58] Field of Search ..... 53/262, 261, 255, 248, 53/247, 539, 246; 193/32

[56] References Cited

U.S. PATENT DOCUMENTS

| | | | |
|---|---|---|---|
| 2,179,648 | 11/1939 | Thayer | 53/262 X |
| 3,031,820 | 5/1962 | Schulze et al. | 53/247 |
| 3,057,136 | 10/1962 | Walter | 53/262 |
| 3,325,967 | 6/1967 | Wild | 53/262 |
| 3,385,027 | 5/1968 | Copping et al. | 53/248 |
| 3,788,034 | 1/1974 | Hartness et al. | 53/248 |
| 3,908,339 | 9/1975 | Kennedy et al. | 53/248 |
| 3,911,647 | 10/1975 | Hartness et al. | 53/248 |
| 3,922,836 | 12/1975 | McGill | 53/248 |
| 4,075,819 | 2/1978 | Raudat et al. | 53/262 X |
| 4,608,804 | 9/1986 | Wild | 53/262 |
| 4,726,167 | 2/1988 | Hartness | 53/248 |
| 4,833,860 | 5/1989 | Hartness | 53/261 |
| 5,150,563 | 9/1992 | Hartness | 53/539 |

*Primary Examiner*—James F. Coan
*Attorney, Agent, or Firm*—Dority & Manning

[57] ABSTRACT

A grid finger for use in a grid structure for delivering articles from an article supply source to compartments and containers. The finger is a readily removable flexible finger that has a substantially flat main body portion, a right angle flange portion adjacent the top of the main body portion, and a flexible elongated flat article engaging section. A compressible resilient member is carried by the right angle flange portion so that it can be readily secured to and released from an elongated slot provided in the grid.

10 Claims, 6 Drawing Sheets

GRID FINGERS

BACKGROUND OF THE INVENTION

This invention relates to a grid finger assembly attachable to a grid structure for guiding articles delivered to the grid structure into compartments of containers.

Heretofore, it has been well known that grids have been utilized with automatic bottle packaging equipment which are designed to conduct and guide bottles, cans and the like into crates or cartons. Sometimes the cartons or containers have petitions therein which must be properly oriented for receiving the article. Grid fingers are provided for directing the articles being dropped from a supplier of articles through the grid into the particular location within the container.

Heretofore, grid fingers have been constructed of many different types of design. For example, in U.S. Pat. No. 3,385,027, there is disclosed corner mounted flexible grid fingers that are used in bottle loading machines. The grid fingers are secured to elongated side plates or dividers by rivets.

Another example of flexible fingers being used in grid sets of article loading machines is disclosed in U.S. Pat. No. 3,325,967 granted to A. J. Wild.

In order to make the grid fingers more readily removable when damaged or when it is desired to change to a different style, a compressible resilient member is provided on a top portion of the flexible finger which nest within a circular opening provided in an elongated divider rail. Such a securing device is disclosed in by earlier U.S. Pat. No. 4,726,167.

A typical article loading machine in which the grid and grid fingers of the subject invention can be used is disclosed in my earlier U.S. Pat. No. 3,788,038 and is incorporated herein by reference. In still another one of my earlier patents, U.S. Pat. No. 5,150,563, I disclosed a grid set for loading square or round containers into boxes.

Some prior art grid sets that used thin flexible spring steel fingers have them mounted on elongated side members as well as cross members. This presents a problem in that when a charge of bottles is dropped, some strike the cross members interfering with the loading operation. In an attempt to overcome the problem with thin flexible spring steel fingers mounted on the elongated dividers as well as the cross dividers, rigid corner mounted fingers were developed such as shown in my U.S. Pat. No. 3,911,647. Even though corner mounted rigid fingers work extremely well, in some applications it is still desirable to utilize the thin spring steel fingers.

Accordingly, it is an important object of the present invention to provide a thin spring steel finger that can be readily mounted and removed from a grid.

Another important object of the present invention is to provide a thin flexible spring steel finger for a grid of a case packing machine which when cooperating with other fingers define a pocket through which articles drop even though all of the spring steel fingers are supported on elongated divider plates.

Still another object of the present invention is to provide a simple and efficient guide finger for a grid of an article loading machine.

SUMMARY OF THE PRESENT INVENTION

The present invention relates to a grid structure for delivering articles from an article supply source to compartments and containers. The grid structure includes a plurality of vertically extending elongated spaced members which have side mounted flexible fingers carried at spaced intervals along a longitudinal axis of the elongated members. Corner mounted flexible fingers are carried at spaced intervals along the longitudinal axis of the elongated members for cooperating with the side mounted flexible fingers to define pockets through which said articles pass as the articles are loaded into the containers.

Elongated slots are provided in the upper surface of the vertically extended elongated space members. The corner mounted flexible fingers include a vertically extending substantially flat main body portion, a right angle flange portion integral with an upper portion of the main body portion and a flexible elongated flat article engaging section integral with a lower portion of the main body portion. The article engaging section extends away from the main body portion at an acute angle to the main body portion in the direction of the longitudinal axis of the elongated member. The right angle flanges of the corner mounted flexible fingers are inserted in respective elongated slots provided in the upper surface of the vertically extending elongated spaced members for supporting the corner mounted flexible fingers on the elongated members.

Compressible releasable members are carried by the flange portion of the corner mounted flexible fingers and when the finger is inserted in the elongated slots provided in the upper surface of the vertically extending elongated spaced member, they protrude through openings provided in the side wall of the elongated spaced members to lock the fingers on the elongated spaced members.

DESCRIPTION OF THE PREFERRED EMBODIMENT

Figure 1:
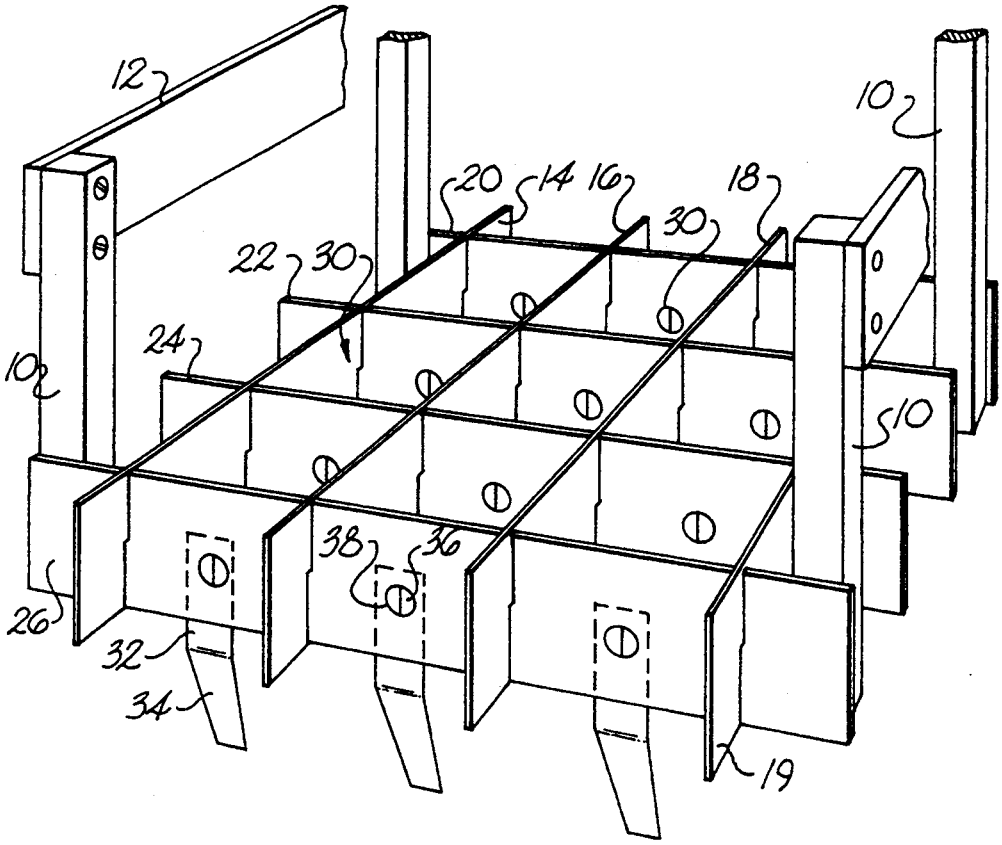
PRIOR ART Fig. 1
FIG. 1 is a perspective view of a prior art grid system equipped with flexible spring steel fingers.

Referring to FIG. 1 of the drawing, there is illustrated a prior art grid that can be used in an article loading machine wherein charges of articles are dropped through the grid into cartons positioned below the grid. The grid is supported by vertically extending posts 10 that form part of the case packing machine. Horizontal braces 12 extend between the vertically extending post 10. As shown in FIG. 1, the grid is designed for dropping a charge of nine articles such as bottles. The grid is formed by elongated vertically extending spaced members 14, 16, 18 and 19 that are joined by cross members 20, 22, 24 and 26 to define pockets 30 through which articles are dropped. Side mounted fingers are carried on each of the elongated spaced members and the cross members for guiding the articles into cartons or particular compartments of containers. The side mounted fingers are made of thin flexible steel and have a lower portion 34 which is bent inwardly towards the center of each of the pockets for engaging the bottle as it is dropped therethrough. The side mounted fingers are secured to the elongated spaced vertical members 14, 16, 18 and 19 as well as the cross members 20, 22, 24 and 26 by means of a releasable connection. The particular connection is described in U.S. Pat. No. 4,726,167 and includes a compressible member 36.

The compressible member 36 projects out a hole 38 provided in the side of the elongated vertically spaced members and the cross members. The elongated spaced members 14, 16, 18 and 19 as well as the cross members 20, 22, 24 and 26 are constructed of three pieces of metal sandwiched together such as shown in greater detail in U.S. Pat. No. 4,726,167. A portion of the intermediate piece of material is removed which allows an upper portion of the flexible finger to slide through a slot so that the compressible member can engage the hole 38.

Figure 2:
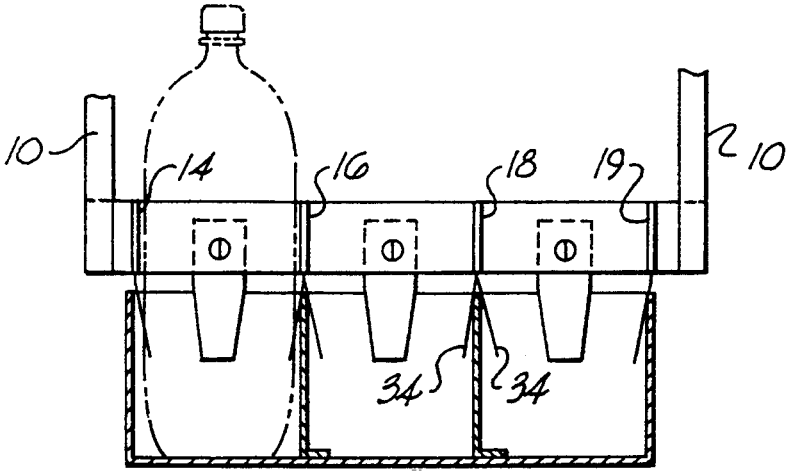
PRIOR ART Fig. 2
FIG. 2 is a side elevational view in section of the prior art grid.
Figure 3:
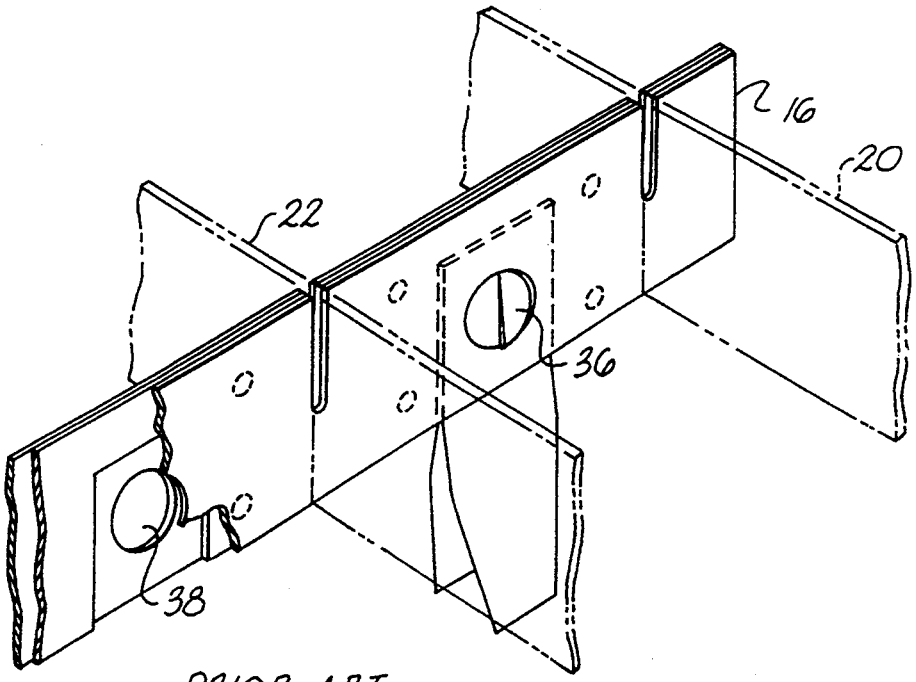
PRIOR ART Fig. 3
FIG. 3 is an enlarged perspective view of a portion of the prior art grid set with portions broken away to illustrate its construction.
Figure 4:
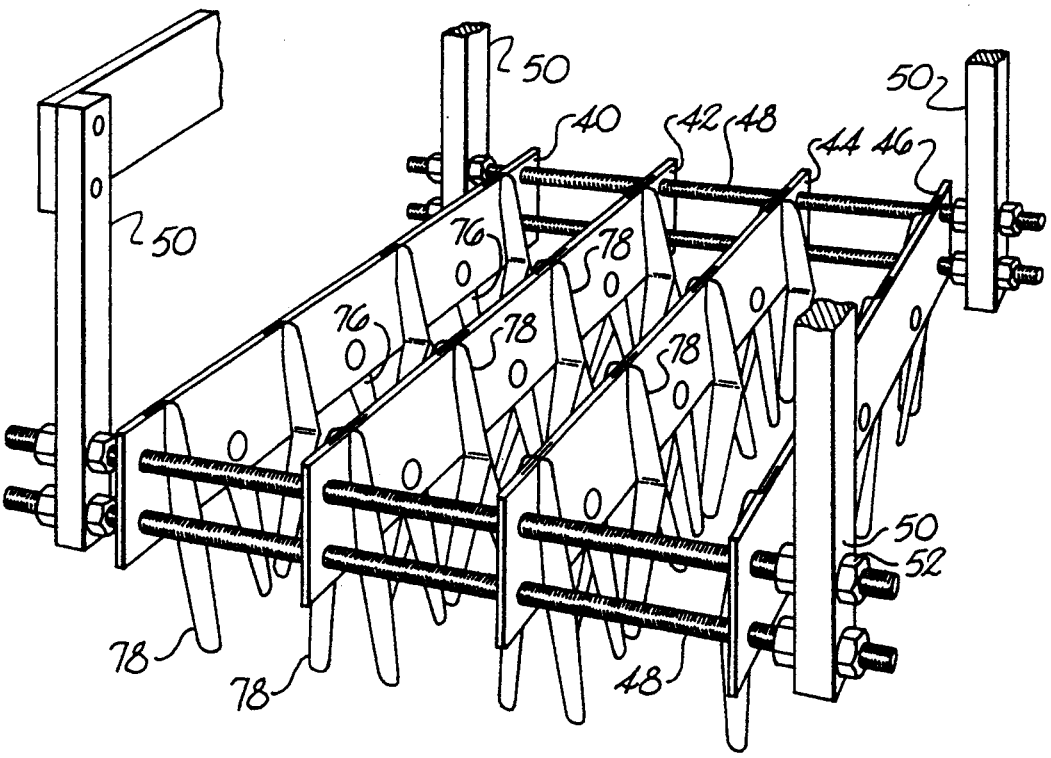
FIG. 4 is a perspective view of a grid constructed in accordance with the present invention and equipped with fingers constructed in accordance with the present invention.

One problem with the prior art grid that is disclosed in FIGS. 1 through 3 is that when the grid is designed for dropping 12 bottles, the longitudinal distance from the outer surface of the cross member 26 must be equal to the diameter of 12 bottles being dropped, the thickness of eleven of the cross members which would be 11 times 3/32" plus a clearance of 1/16" for each of the pockets would be an additional distance of 12/16". As a result, the length of the grid is approximately 57/32" greater than the space occupied by 12 bottles. This sometime presents a problem in that the bottles will strike the cross members upon which the fingers 34 are mounted when being dropped into containers.

The grid constructed in accordance with the present invention does not have cross members. Therefore, the problem of the articles striking the cross members as they drop through is eliminated.

The grid shown in FIGS. 4 through 8 of the drawings is designed for guiding a charge of 9 articles into a container. Of course, it is to be understood that the grid could readily be enlarged to accommodate any size charge such as cases containing 12 articles. The grid shown in FIG. 4 includes a plurality of vertically extending elongated members 40, 42, 44 and 46. The elongated members 40, 42, 44 and 46 are carried on threaded rods 48 which are in turn secured to vertically extending posts 50 forming part of the grid. The rods 48 can be adjusted by manipulating nuts 52. Nuts can also be used for positioning the vertically extending elongated spacer members 40, 42, 44 and 46 on the threaded rods 48 to accommodate different size articles.

Figure 7:
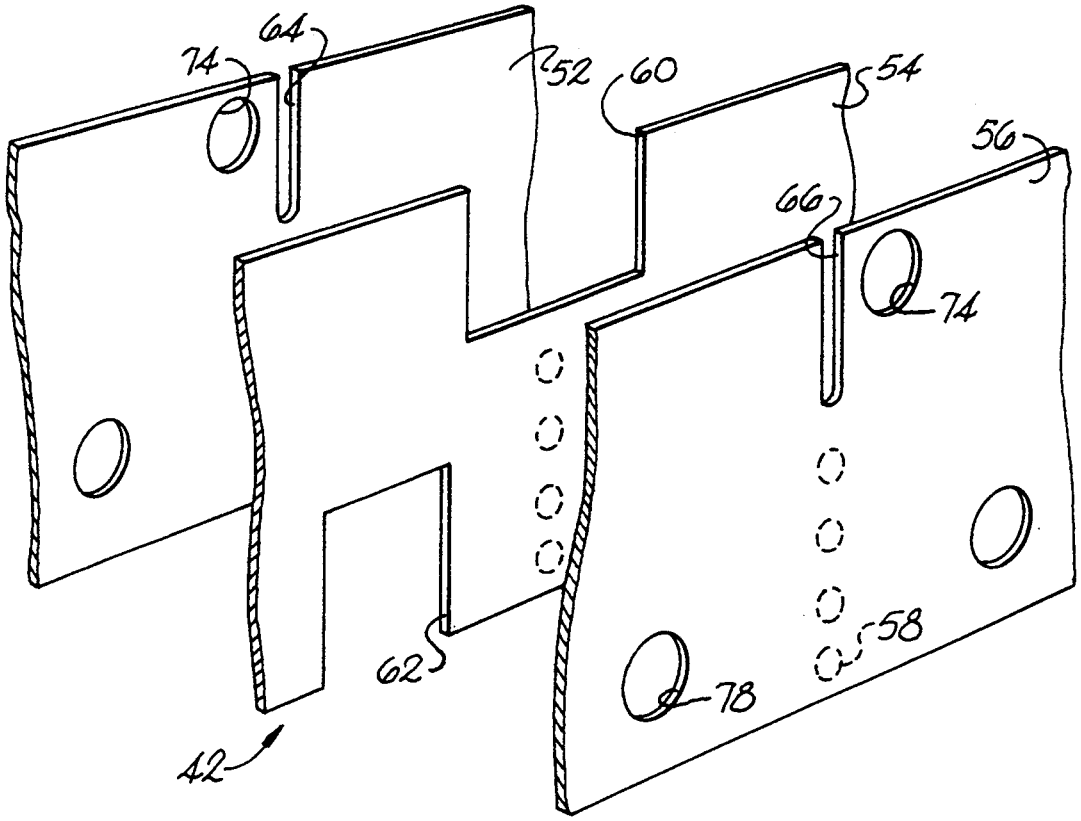
FIG. 7 is an exploded view illustrating the construction of the elongated spaced members forming part of the grid.

The vertically extending elongated spaced members are constructed of three plates that are sandwiched together such as shown in FIG. 7. The three plates 52, 54 and 56 are secured together by spot wells 58. The inner plate 54 has a notched out areas 60 adjacent its top surface and a notched out areas 62 spaced longitudinally therefrom and on the bottom edge thereof. The outer plate 52 has a vertically extending slot 64 provided therein. A similar vertically extending slot 66 is provided in the upper surface of the side plate 56. As a result, when these three plates 52, 54 and 56 are secured together, elongated longitudinally spaced slots 68 are provided in the upper surface of the vertically extending elongated spaced members 40, 42, 44 and 46. The slots 68 include a longitudinal extending portion 70 and a vertically extending slot portion 72.

Adjacent each of the slots 68 is a circular opening 74 the function of which will be discussed later. The slot provided in the bottom of the elongated spaced members 40, 42, 44 and 46 are provided for receiving side mounted fingers 76. Each of the side mounted fingers 76 have a compressible member which is permitted to extend through an opening 78 provided in the wall of the elongated member for securing the side mounted fingers in a bottom portion of the vertically extending elongated spaced members 40, 42, 44, 46 as shown in FIG. 3 which represent the prior art. The only difference is that the compressible member is rotated 90 degrees since it has been found to be more effective for locking and releasing the finger.

Corner mounted flexible fingers 78 are carried at spaced intervals along the longitudinal axis of the elongated members 40, 42, 44 and 46 for cooperating with the side mounted flexible fingers 76 to define pockets through which the articles 80 are loaded into containers as they are dropped through the grid.

The corner mounted flexible fingers 78 include a main body portion 82 constructed of thin flexible steel. A right angle flange portion 84 is integral with an upper portion of the main body portion 82. A flexible elongated flat article engaging section 84 is integral with a lower portion of the main body portion. The article engaging section extends away from the main body portion at an acute angle alpha. The article engaging section 86 extends outwardly at the acute angle in the direction of the longitudinal axis 88 of the elongated member 40.

Figure 5:
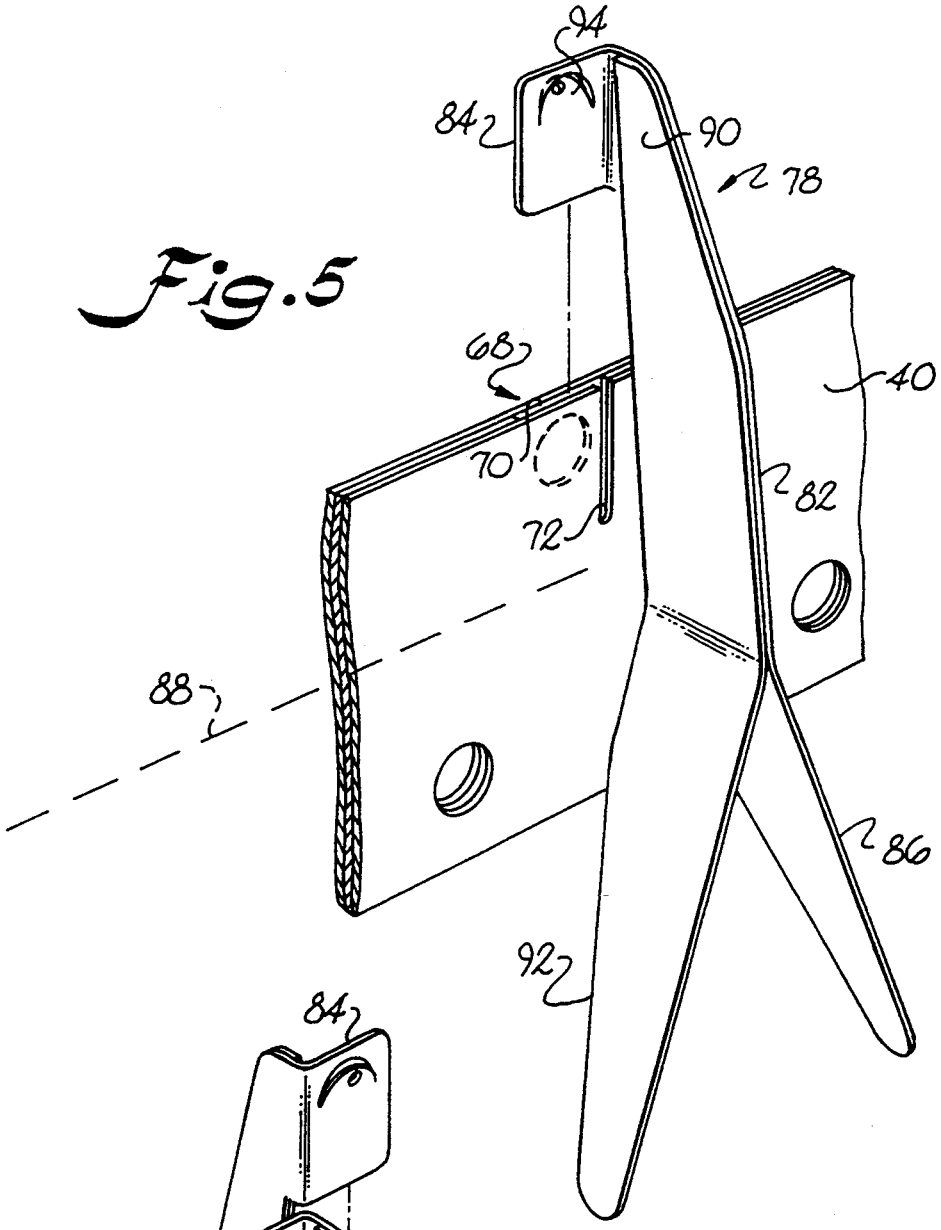
FIG. 5 is an enlarged perspective view illustrating one particular corner mounted finger being inserted into a slot on the elongated divider rails.
Figure 6:
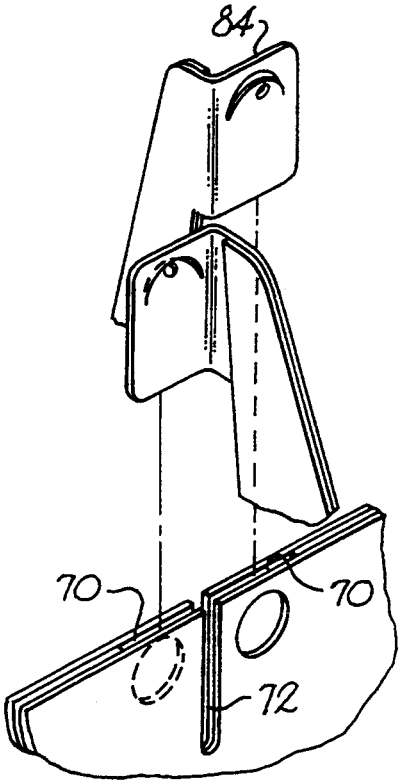
FIG. 6 is a perspective view illustrating the manner in which two abutting corner mounted fingers are inserted on one of the interior elongated members used for supporting the fingers.
Figure 8:
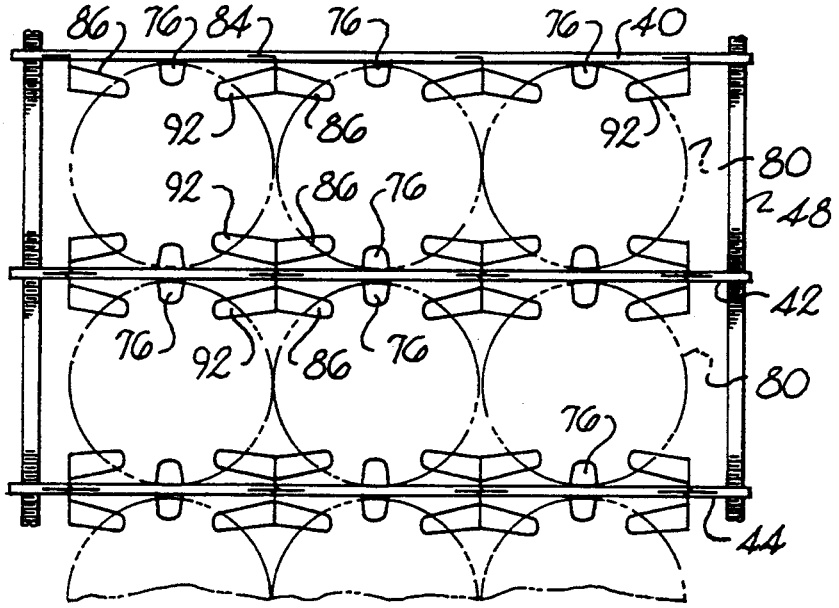
FIG. 8 is a plan view illustrating a portion of a grid equipped with fingers constructed in accordance with the present invention.

As shown in FIG. 5, the finger 78 can include a second main body portion 90 and which has an article engaging portion 92 integral with a lower end thereof that is bent at an acute angle alpha in the opposite direction from the article engaging portion 86. This permits the single flange 84 to support two article engaging portions 86 and 92 which aid in directing articles through adjacent pockets such as shown in FIG. 8. At the ends of the grid, the second main body portion is not utilized since it is not necessary.

A compressible resilient member 94 is carried by the flange portion 84 of the corner mounted flexible fingers 78. The compressible resilient member is a semi-circular stamped tab that projects out beyond the flat side surface of the flange to secure the fingers in the elongated vertically extending spaced members by abutting against the side walls encircling the openings 74.

When it is desired to change the fingers 78, it is only necessary to compress the resilient member 94 and lift the finger out of the elongated slot 68. As a result, when it is desired to change the fingers or replace the fingers, if such become damaged, an operator can quickly make such a change.

As can be seen in FIG. 8, since no cross members are utilized in the grid, the bottles or articles 80 can abut against each other as they are dropped through the grid and the side mounted fingers 76 cooperating with the corner mounting fingers 78 guide the bottles through the grid set into respective compartments of the container.

Figure 9:
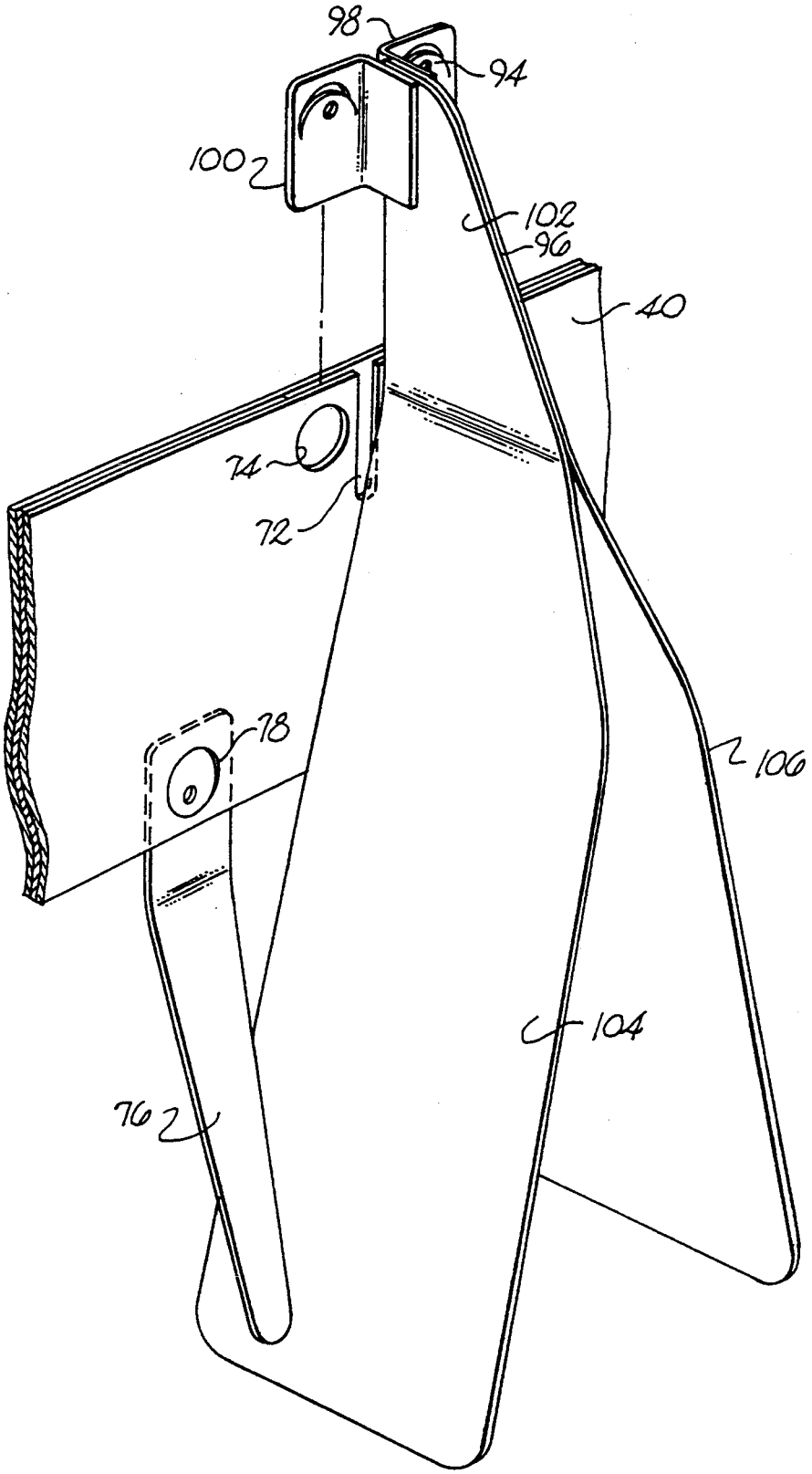
FIG. 9 is an enlarged perspective view illustrating a modified form of the invention including a modified finger.

In FIG. 9, there is illustrated a modified finger constructed in accordance with the present invention. The finger disclosed in FIG. 9 is a much more rugged finger than the finger shown in FIG. 5 and two of the fingers such as shown in FIG. 9 can cooperate with two side mounted fingers 76 to define a pocket through articles or dropped. The finger of FIG. 9 includes a pair of flanged members 98 and 100 which are secured to a main body portion 102 of the finger as by spot welding or the like. The flange portions 98 have a compressible resilient member 94 provided thereon so that the finger can be readily locked within holes provided in the elongated slots 68. Integral with a lower portion of the main body portion 102 is a substantially flat bottle engaging portion 104. In actuality, the major portion of the finger is constructed of two pieces of flat metal to define the main body 102 at a pair of diverging bottle engaging portions 104 and 106. While the bottle engaging portion of the fingers are shown to be flat, it is to be understood that other suitable shapes for guiding articles through pockets could be used without departing from the spirit or scope of the invention.

Figure 10:
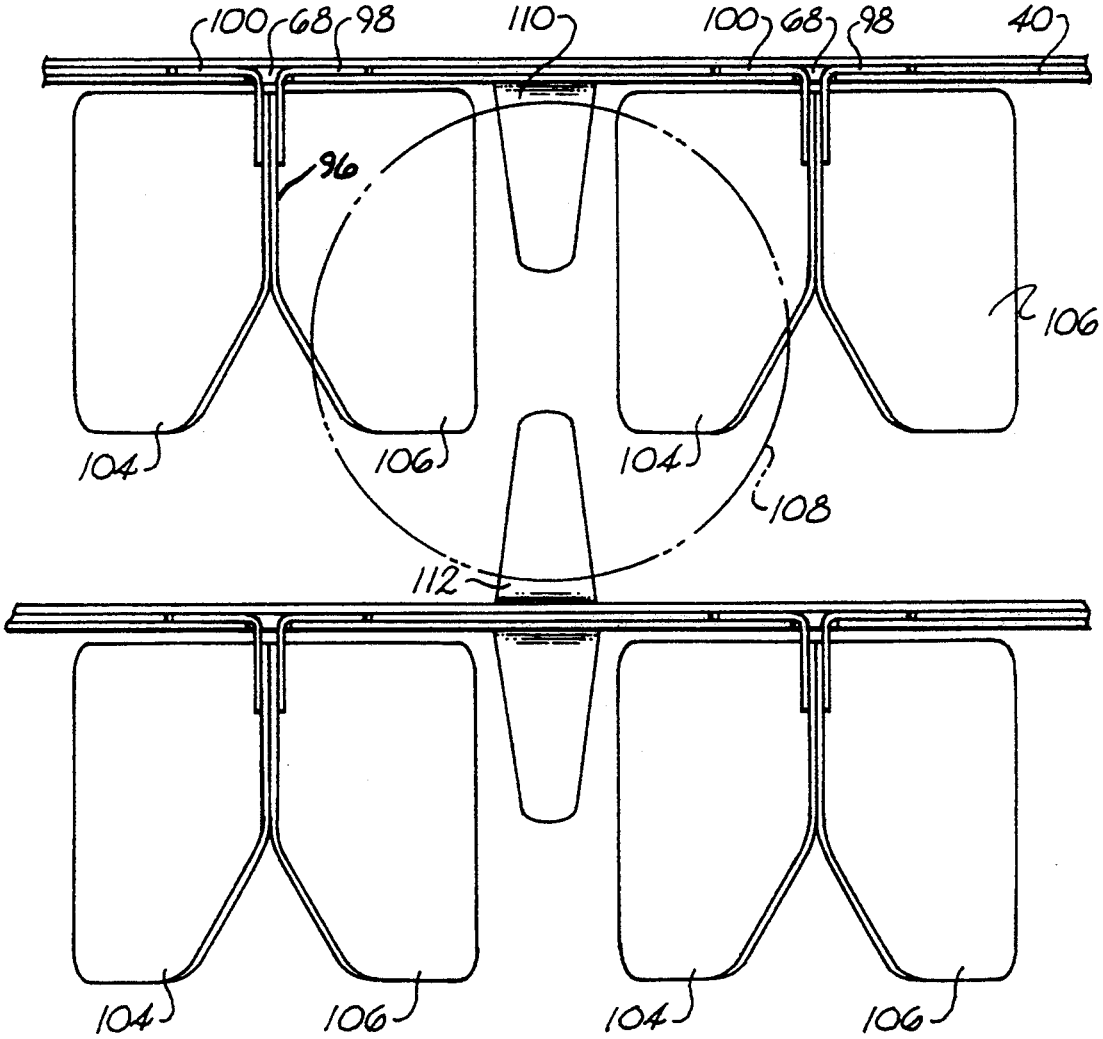
FIG. 10 is a plan view illustrating a portion of a grid equipped with the modified finger of FIG. 9.

In FIG. 10, there is shown a portion of a grid set that would include a pair of adjacent vertically extending elongated spaced members 40 and 42. Each of the members 40 and 42 are provided with slots 68 for receiving the flange portions of the fingers 96. The circular dotted line 108 represents the shape of an article that would normally be dropped through the pocket defined by two opposed fingers 96 and the two side fingers 110 and 112. The side fingers 110 and 112 are of the same construction as the earlier described side fingers 76 and are mounted in the lower portion of the vertically extending elongated spaced members 42 and 44 as shown in FIG. 9. As can be seen from FIG. 10, the side fingers 110 and 112 engage the article on surfaces 180° opposed from each other. The bottle engaging surfaces 104 and 106 of fingers 96 engage the articles at points 90° from the engagement surface of the fingers 110 and 112. As a result, each of the four fingers engages the bottle or article approximately 90° from the next adjacent finger.

The pockets through which the articles drop are defined by the four fingers, 104, 106, 110, and 112 as best shown in FIG. 10.

While a preferred embodiment of the invention has been described using the specific terms, such description is for illustrative purposes only and it is to be understood that changes in variations may be made without departing from the spirit of the scope of the following claims.

What is claimed is:

1. A grid structure for delivering articles from an article supply source to compartments in containers, the grid structure comprising:

a plurality of vertically extending elongated spaced members, side mounted flexible fingers carried at spaced intervals along the longitudinal axis of said elongated members, corner mounted flexible fingers carried at spaced intervals along the longitudinal axis of said elongated members for cooperating with said side mounted flexible fingers to define pockets through which said articles pass as said articles are loaded into said containers, elongated slots provided in an upper surface of said vertically extending elongated spaced members, said corner mounted flexible fingers including:

(i) a vertically extending substantially flat main body portion, (ii) a right angle flange portion integral with an upper portion of said main body portion, and (iii) a flexible elongated flat article engaging section integral with a lower portion of said main body portion, said article engaging section extending away from said main body portion at an acute angle to said main body portion in the direction of the longitudinal axis of said elongated member, and said right angle flanges of said corner mounted flexible fingers being inserted in respective elongated slots provided in said upper surface of said vertically extending elongated spaced members for supporting said corner mounted flexible fingers on said elongated members.

2. The grid structure as set forth in claim 1 further comprising:

openings provided in the side walls of said elongated member communicating with said elongated slots, compressible resilient members carried by said flange portions of said corner mounted flexible fingers which project out said openings provided in said side walls of said elongated member for releasably securing said fingers to said elongated members.

3. The grid structure as set forth in claim 1 wherein said elongated slots provided in said upper surface of said vertically extending elongated spaced members include a longitudinally extending slot portion and a vertically extending slot portion.

4. The grid structure as set forth in claim 3 further comprising:

a junction provided at an intersection of said right angle flange portion and said upper portion of said main body portion of said corner mounted flexible finger, so that said junction rides in said vertically extending slot portion of said elongated slot when said flange portion is inserted in said longitudinally extending slot portion of said elongated slot.

5. A readily removable flexible finger for use in a grid structure of an article loading machine, said grid structure including vertically extending elongated spaced members through which articles are dropped from a supply source, elongated slots provided in said vertically extending elongated members, said flexible finger comprising:

(a) a vertically extending substantially flat main body portion, (b) a right angle flange portion integral with an upper portion of said main body portion capable of being inserted in one of said elongated slots of said vertically extending elongated members.

(c) a flexible elongated flat article engaging section integral with a lower portion of said main body portion, and (d) said article engaging section extending away from said main body portion at an acute angle to said main body portion.

6. The readily removable flexible finger as set forth in claim 5 further comprising:

a compressible resilient member carried on said flange portion of said flexible finger for releasably securing said finger to said elongated member.

7. A readily removable flexible finger for use in a grid structure of an article loading machine, said grid structure including vertically extending elongated spaced members through which articles are dropped from a supply source, elongated slots provided in said vertically extending elongated members, a longitudinal axis extending along the length of said elongated members, said flexible finger comprising:

(a) a flange portion capable of being inserted in one of said elongated slots of said vertically extending elongated members, (b) a flexible elongated article engaging section, connected to said flange portion at a right angle, and (c) said article engaging section extending at an angle in the direction of said longitudinal axis of said elongated members.

8. A readily removable flexible finger for use in a grid structure of an article loading machine, said grid structure including vertically extending elongated spaced members through which articles are dropped from a supply source, elongated slots provided in said vertically extending elongated members, said flexible finger comprising:

(a) a vertically extending main body portion, (b) a right angle flange portion integral with an upper portion of said main body portion capable of being inserted in one of said elongated slots of said vertically extending elongated members, (c) a flexible elongated article engaging section integral with a lower portion of said main body portion, and (d) said article engaging section extending away from said main body portion at an acute angle to said main body portion.

9. The grid structure as set forth in claim 8 wherein said flexible elongated article engaging section is substantially flat.

10. A grid structure for delivering articles from an article supply source to compartments in containers, the grid structure comprising:

a plurality of vertically extending elongated spaced members, first flexible fingers carried at spaced intervals along the longitudinal axis of said elongated members for engaging articles dropped through said grid structure, second flexible fingers carried at spaced intervals along the longitudinal axis of said elongated members for cooperating with said first flexible fingers to define pockets through which said articles pass as said articles are loaded into said containers, said second grid fingers engaging said articles approximately 90° from said first flexible fingers, elongated slots provided in an upper surface of said vertically extending elongated spaced members, said second flexible fingers including:

(i) a vertically extending substantially flat main body portion, (ii) a right angle flange portion integral with an upper portion of said main body portion, and (iii) a flexible elongated article engaging section integral with a lower portion of said main body portion, said article engaging section extending away from said main body portion at an acute angle to said main body portion in the direction of the longitudinal axis of said elongated member, and said right angle flanges of said second flexible fingers being inserted in respective elongated slots provided in said upper surface of said vertically extending elongated spaced members for supporting said corner mounted flexible fingers on said elongated members.

* * * * *